United States Patent [19]

Eikerman et al.

[11] 4,341,516

[45] Jul. 27, 1982

[54] GRAIN DRYER WITH HEAT EXCHANGE ASSEMBLY

[75] Inventors: H. H. Eikerman, Kerney, Nebr.; Joseph L. Naylor, Norman, Okla.

[73] Assignee: Blount, Inc., Montgomery, Ala.

[21] Appl. No.: 264,348

[22] Filed: May 18, 1981

[51] Int. Cl.[3] ..... F27D 1/08; F26B 17/12

[52] U.S. Cl. ..... 432/95; 34/170; 34/177; 432/102

[58] Field of Search ..... 432/95, 102; 34/170, 34/177

[56] References Cited

U.S. PATENT DOCUMENTS

| | | | |
|---|---|---|---|
| 1,763,538 | 6/1930 | Randolph | 34/177 |
| 1,880,229 | 10/1932 | Andrews et al. | 432/30 |
| 1,950,263 | 3/1934 | Pellegrino et al. | 432/102 |
| 2,706,345 | 4/1955 | Arndt | 432/102 |
| 4,006,536 | 2/1977 | Meiners | 34/170 |
| 4,067,120 | 1/1978 | Bradford | 34/170 |
| 4,086,708 | 5/1978 | Westelaken | 34/170 |
| 4,173,924 | 11/1979 | Bradshaw | 98/115 SB |

*Primary Examiner*—John J. Camby

*Attorney, Agent, or Firm*—Dann, Dorfman, Herrell and Skillman

[57] ABSTRACT

In accordance with the present invention, a grain dryer having a heat exchange assembly is provided. The grain dryer comprises a housing and a generally vertical granular-material conduit for conducting granular material through the housing. The heat exchange assembly of the dryer comprises heat exchange means having a gas passageway and at least one tubular radiator element disposed in the passageway. Means is provided for causing hot combustion gas to flow through the hollow interior of the radiator element to heat the element, with the temperature of the discharged combustion gas being reduced. A gas conduit directs the flow of discharged combustion gas from the tubular radiator element through the passageway of the heat exchange means externally of the tubular radiator element to increase the temperature of the discharged combustion gas. The flow of combustion gas from the passageway of the heat exchange means is then introduced into the granular-material conduit to evaporate moisture from the granular material therein. The gas-flow conduit has separation means to eliminate particulate materials such as sparks, combustable materials or other by-products of combustion from the combustion gas, including a filter, a baffle wall, and side walls to turn the flow of combustion gas through 270°.

38 Claims, 4 Drawing Figures

FIG. 1
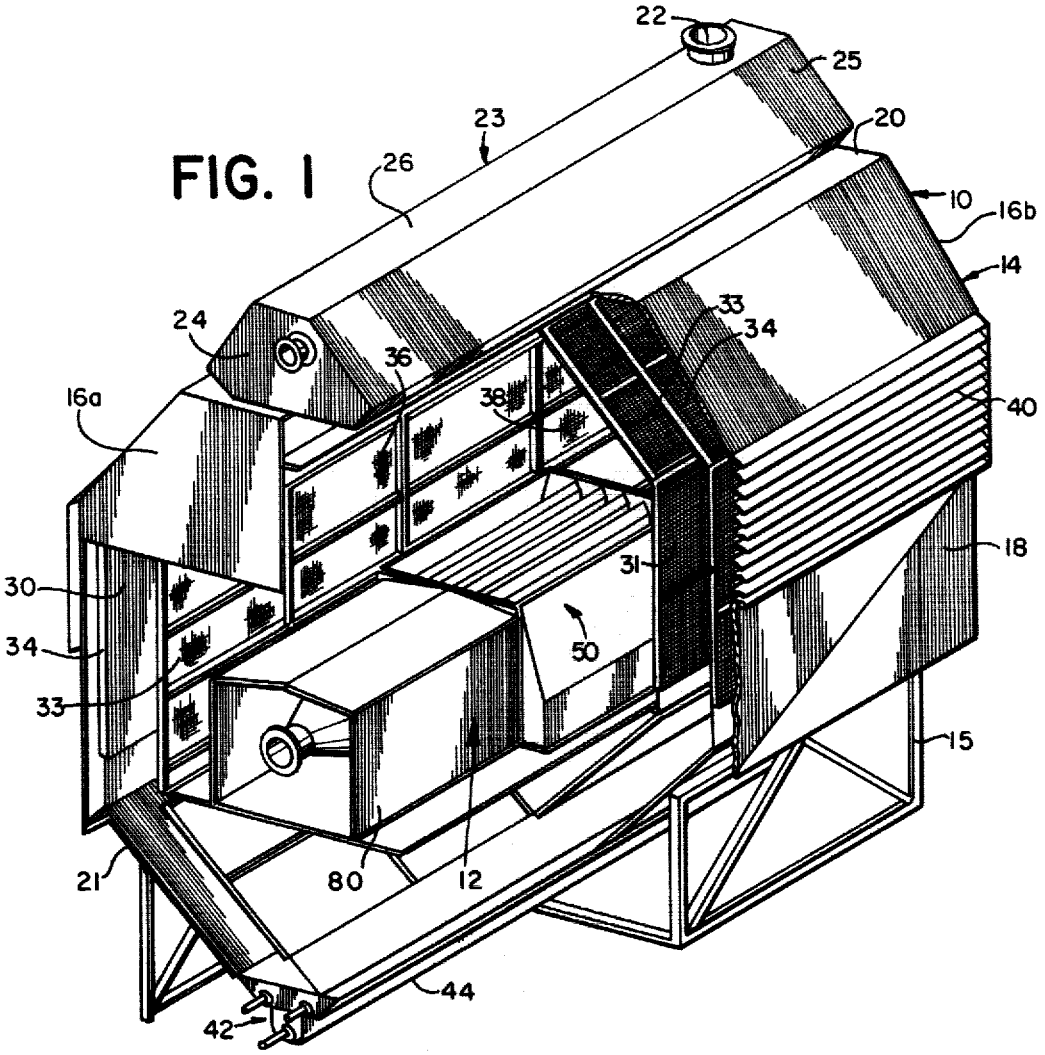
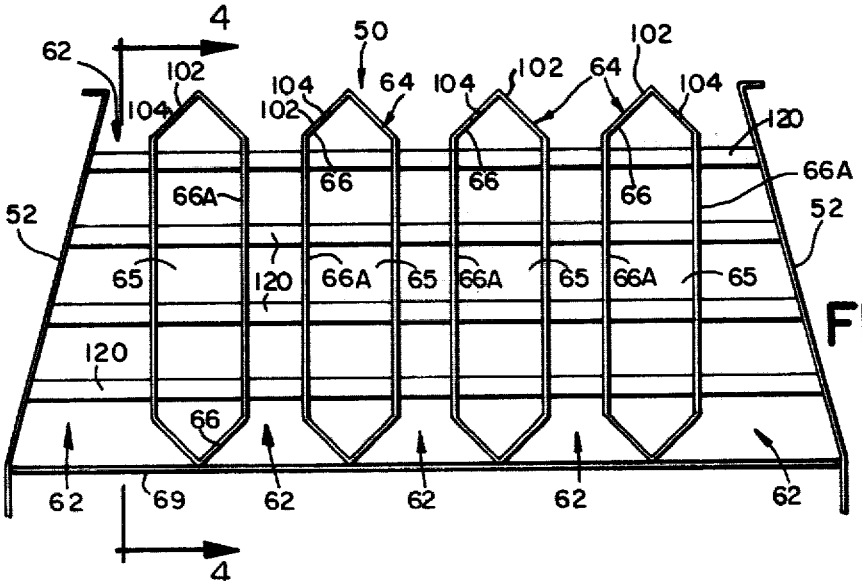
FIG. 3

GRAIN DRYER WITH HEAT EXCHANGE ASSEMBLY

BACKGROUND OF INVENTION

The present invention relates to an apparatus for drying granular material which includes an improved heat exchange assembly that efficiently utilizes the heat generated by combustion within a burner without the danger of having flames or sparks directly impinge upon the granular material being dried.

In conventional grain dryers, the combustion gas output of a burner unit, typically a propane gas burner with a high power output blower, is introduced into the dryer so as to directly impinge upon wet granular material being conducted through a drying column. The flow of hot combustion gas through the granular material in the drying column dries the granular material by causing unwanted moisture to be evaporated therefrom. Although this type of dryer is generally effective for drying certain types of grain, such as corn, when this type of dryer is employed to dry other granular products, such as sunflower seeds, safflower seeds, soybeans, or other types of oil-based seeds, sparks or flames within the flow of combustion gas from the burner may directly impinge on the granular material and result in the possibility of fires caused by the ignition of granular material within the drying column.

SUMMARY OF INVENTION

In accordance with the present invention, an apparatus is provided which eliminates the possibility of fires within the grain column while efficiently utilizing the heat generated by combustion within a burner unit. The present invention provides an apparatus for drying granular material having a heat exchange assembly, a housing, and means for defining a granular-material conduit for conducting the granular material through the housing. The heat exchange assembly comprises heat exchange means having a gas passageway and at least one generally tubular radiator element disposed in the passageway. Furthermore, the assembly includes means for causing hot combustion gas to flow through the hollow interior of the tubular radiator element so as to heat the element, with the temperature of the discharged combustion gas being reduced. The assembly also comprises gas conduit means for directing the flow of discharged combustion gas from the tubular radiator element through the gas passageway of the heat exchange means externally of the tubular radiator element such that the temperature of the discharged combustion gas is increased. The combustion gas is then introduced into the conduit for granular material to contact and treat the granular material therein. Suitable separation means is provided in the flow path of the combustion gas prior to its flow into the granular-material conduit in order to eliminate particulate material which may generate sparks or flames in the combustion gas.

BRIEF DESCRIPTION OF THE DRAWINGS

In order to more completely understand the apparatus in accordance with the present invention, a preferred embodiment is illustrated by the appended drawings in which:

FIG. 1 is a perspective view, partially cut away, of a preferred embodiment of an apparatus for drying granular material having a heat exchange assembly in accordance with the present invention;

FIG. 3 is a cross-sectional view of the heat exchange assembly taken along line 3—3 of FIG. 2.

DESCRIPTION OF THE PREFERRED EMBODIMENT

Figures 2, 4:
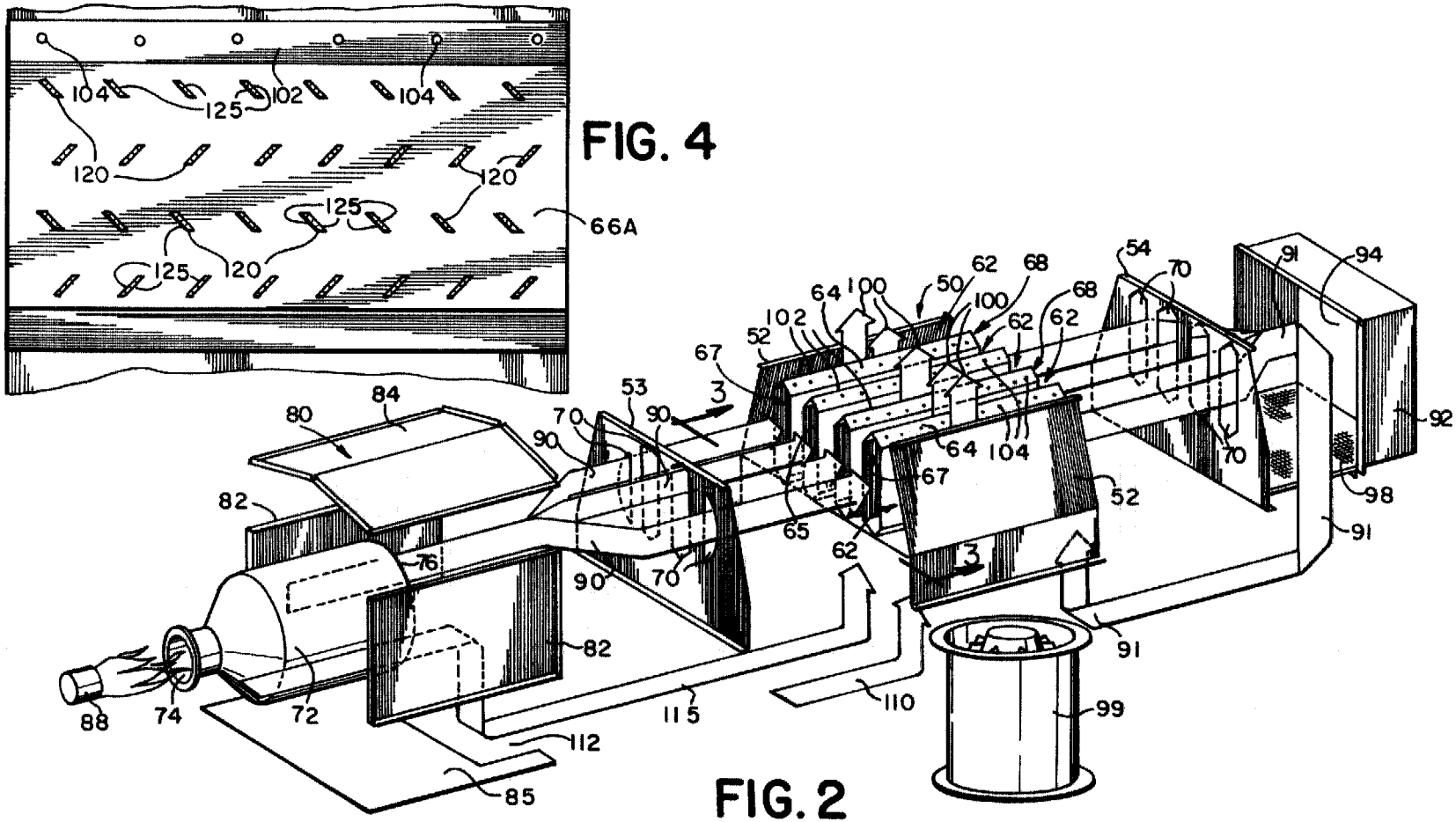
FIG. 2 is an exploded perspective view of the heat exchange assembly illustrated in FIG. 1.
FIG. 4 is a cross-sectional view of the heat exchange assembly taken along line 4—4 of FIG. 3.

Referring to FIG. 1, in accordance with the present invention a grain dryer, generally designated 10, has a heat exchange assembly, generally designated 12, positioned and supported therein. The grain dryer 10 comprises a housing 14 supported in a vertically upright position by metal bracing structure 15 at the base of the housing. The housing 14 includes end walls 16*a* and 16*b*, side walls 18, top walls 20, and bottom walls 21, constructed of suitable material such as sheet metal supported by braces to properly enclose and protect the internal structure of the grain dryer housed therein.

Grain inlet means 22 is provided at the top of the housing through which the particulate or granular material to be treated is introduced into the grain dryer. From the grain inlet means 22 the grain falls in response to gravity into an elongated garner bin 23 positioned at the upper level of the housing, the garner bin 23 having end walls 24, side walls 25, and a top wall 26 constructed of sheet metal supported by braces. From the garner bin 23 the granular material is fed into the top of a granular-material conduit system which guides the granular material generally vertically within the housing so that the granular material entering the conduit will flow therethrough in response to gravity. As illustrated in FIG. 1, the granular-material conduit comprises two branches 30 and 31, each having inner and outer foraminous wall means 33 and 34 constructed of stainless steel screening supported by metal braces 36. The inner and outer foraminous wall means 33 and 34 of each branch are generally vertical and oppose one another so as to form respective inner and outer boundary layers for a granular treating column therebetween. Furthermore, the branches of the conduit 30 and 31 are spaced apart with the inner foraminous wall means 33 of the respective branches opposing one another so as to define a treating fluid inlet region 38 therebetween.

The heat exchange assembly 12 is supported and disposed in the treating fluid inlet region 38 between the opposing inner foraminous wall means 33 of the respective branches 30 and 31 of the conduit so that hot combustion air supplied through the heat exchange assembly 12 can be introduced into the grain columns through the inner foraminous wall means 31 of each branch. As the hot combustion air passes outwardly through the column, unwanted moisture is evaporated from the granular material flowing downwardly therein. The hot combustion air containing the evaporated moisture subsequently passes through the outer foraminous wall means of each grain column and is then exhausted into the atmosphere through exhaust louvers 40 in the respective side walls 18 of the housing. The dried grain from each column then flows into a common trough-like grain receptacle formed by the impervious sheet-metal bottom walls 21 which are positioned and supported at the bottom of the conduit at the bottom level of the housing. The grain receptacle includes means 42, such as a conventional discharge auger, for regulating the flow of dried grain through grain outlet means 44 at the base of the housing.

Referring to FIGS. 2, 3, and 4, the heat exchange assembly 12, as illustrated in an exploded view in FIG. 2, comprises heat exchange means, generally designated 50, having opposing side walls 52 and opposing front and back walls 53 and 54, the walls being constructed of sheet metal. The opposing side walls 52 along with the opposing front and back walls 53 and 54 of the heat exchange means 50 are arranged to form respective vertical boundary layers for a gas passageway 62 that extends upwardly therethrough. The heat exchange means includes a plurality of elongated generally tubular radiator elements 64 which are disposed transversely in the gas passageway 62. The tubular radiator elements 64 are elongated having respective longitudinal hollow interiors 65 confined between elongated sheet metal walls 66. In axial cross-section the walls 66 of each of the elements are disposed in a hexagonal configuration. The tubular radiator elements 64 are disposed generally horizontally and are positioned longitudinally in the gas passageway generally transverse to the opposing front and back walls 53 and 54 of the heat exchange means 50. The generally tubular radiator elements 64 are spaced apart in the gas passageway 52 and are disposed adjacent to one another in a side by side array with the longitudinal axis of the elements being generally parallel in a horizontal direction. The tubular radiator elements 64 are supported in the gas passageway 62 from the underneath by suitable bracing structure 69 connected to the opposing side walls 52 of the heat exchange means 50.

The front wall 53 of the heat exchange means which extends transverse to the longitudinally positioned tubular radiator element 64 embraces the front ends 67 of the tubular radiator elements 64. Similarly, the back wall 54 of the heat exchange means 50 which also extends generally transverse to the longitudinally positioned tubular radiator elements 64 embraces the back ends 68 of the tubular radiator elements. Both the front and back walls 53 and 54 of the heat exchange means have a plurality of passageways or apertures 70 which extend through the respective walls, the apertures 70 being properly dimensioned to correspond and communicate with the respective opposite ends of the hollow interiors of the tubular radiator elements. Consequently, the front and back walls 53 and 54 of the heat exchange means 50 respectively provide gas inlet and outlet manifolds. The front wall 53 functions to divide a gas flow into a plurality of individual gas flows respectively passing through the hollow interiors of the tubular radiator elements 64 of the heat exchange means 50. The back wall 54 of the heat exchange means 50 functions to combine the individual gas flows from the respective tubular radiator elements 64 into a single flow as the individual gas flows are discharged through the ends 68 of the tubular radiator elements 64 through the apertures 70 in the back wall 54.

The heat exchange assembly also includes a generally cylindrical stainless steel combustion chamber 72 having gas inlet and gas outlet means 74 and 76 at the opposing ends. The outlet means 76 registers with the openings 70 in the front wall 53 to define the inlet manifold of the heat exchange means 50. The combustion chamber is supported so that it confronts the front wall 53 of the heat exchange means 50 with the outlet means 76 of the combustion chamber enclosing the apertures 70 in the front wall 53. The combustion chamber is housed within a heat shield chamber, generally designated at 80, having opposing side walls 82, a top wall 84, and a bottom wall 85 cooperating with the front wall 53 to enclose the inlet manifold of the heat exchange means 50.

Means are provided for producing a flow of hot combustion gas through the interiors 65 of the tubular radiator elements 64. A conventional burner unit 88, typically having a propane gas burner with a high power output blower, produces an open flame which is blown into the steel combustion chamber 72 through the gas inlet means 74 of the chamber. The flame produces hot combustion gas which is blown by the high power output blower of the burner unit 88 through the hollow interior of the combustion chamber 72. The hot combustion gas along with sparks and other entrained particulate materials such as the by-products of combustion are subsequently blown through the gas outlet means 76 of the chamber 72 against and through the front wall 53 of the heat exchange means 50. The flow of hot combustion gas along with the sparks and the other particulate materials entrained therein is separated into a plurality of individual flows by the front wall 53 of the heat exchange means 50 with the individual flows passing through the respective passageways or apertures 70 in the front wall 53 as indicated by the flow arrows 90 in FIG. 2. The individual flows of hot combustion gas respectively enter the plurality of tubular radiator elements at their front ends 67.

As the hot combustion gas passes through the hollow interiors of the tubular radiator elements 64, the radiator elements become heated. As a consequence, the combustion gas which is subsequently discharged through the apertures 70 in the back wall 54 of the heat exchange means 50 has a reduced temperature due to the heat loss incurred during the heat exchange with the tubular radiator elements 64. Furthermore, as the individual flows of combustion gas are discharged from the back ends 68 of the tubular radiator elements through the openings 70 in the back wall 54 of the heat exchange means 50, the individual flows of discharged combustion gas are combined into a single flow, as indicated by the flow arrow 91.

Gas conducting means 92 comprising a duct of impervious sheet metal walls is provided for directing and deflecting the flow of discharged combustion gas from the apertures 70 in the back walls 54 of the heat exchange means 50 through a 270° turn and then upwardly through the vertical gas passageway 62 of the heat exchange means 50 externally of the tubular radiator elements 64. The gas conducting means 92 directs the flow of discharged combustion gas from the interior of the tubular radiator elements into external communication with the tubular radiator elements 64 to increase the temperature of the discharged combustion gas. Since the hot combustion gas loses heat while flowing through the interior 65 of the tubular radiator elements 64, some of the heat is transferred back to the combustion gas when the discharged combustion gas flows into external communication with the tubular radiator elements 64 while the discharged combustion gas passes through the gas passageway 62 of the heat exchange means.

The gas conducting means 92 includes a vertically oriented baffle wall 94 which is transverse to the generally horizontal flow of discharged combustion air from the apertures 70 in the back wall 54 of the heat exchange means 50. The baffle wall 94 is generally parallel to and is spaced from the rear end wall 16*b* of the housing (see FIG. 1) such that the baffle wall 94 prevents the flow of discharged combustion gas from contacting the end wall 16*b* of the housing to keep it from becoming heated. Furthermore, the baffle wall will serve as separation means for removing particulate material from the gas flow, since the by-products of combustion, such as liquid propane jelly, that may be entrained in the flow of combustion gas from the burner unit 88 will contact and burn on the baffle wall 94. The discharged combustion gas is then directed by the gas conducting means through the approximately 270° turn so that the generally horizontal flow of discharged combustion gas from the apertures 70 in the back wall 54 of the heat exchange means 50 can be introduced into the bottom of the vertically disposed gas passageway 62 of the heat exchange means 50, and into external communication with the tubular radiator elements 64 as illustrated by the flow arrow 91 in FIG. 2. The walls of the gas conducting means 92 serve as a supplemental separation means; since by forcing the discharged combustion gas to turn approximately 270° through the gas conducting means 92, any heavy particulate materials which are carried in the flow of discharged combustion gas will be precipitated out against the walls.

To eliminate any large-sized particles from the flow, a further separation means is also employed. To this end, stainless steel screening 98, serving as filtering means, is disposed across the interior of the gas conducting means generally transverse to the flow of discharged combustion gas therethrough. Preferably, the metal screen 98 is mounted for ready removal from the gas conducting means 92 to facilitate cleaning of the screen and the conduit. The filter means may also be disposed at other positions in the flow of combustion gas.

After the flow of discharged combustion gas is filtered, it is then directed by the gas conducting means 92 generally vertically upwardly through the gas passageway 62 of the heat exchange means 50 externally of the tubular radiator elements 64 in order to increase the temperature of the combustion gas. A conventional blower 99 may be connected to the gas conducting means 92 at the bottom of the gas passageway 62 to help force the flow of discharge combustion gas upwardly through the gas passageway 62 of the heat exchange means 50, as illustrated by the flow arrows 100 in FIG. 2. In the illustrated embodiment, the top walls 102 of the horizontal tubular radiator elements 64 may be perforated as indicated at 104 to permit a flow of hot combustion gas from the interiors of the tubular radiator elements to escape upwardly therethrough. However, the perforations 104 must be of a small enough diameter so that no particles escape from the tubular radiator elements 64 through the perforations along with the flow. The flow of hot combustion gas through the perforations in the top walls 102 of tubular radiator elements combines with the flow of discharged combustion gas passing upwardly through the gas passageway 62 of the heat exchange means 50 to form a combined flow.

In addition to the discharged combuston gas which is forced upwardly through the gas passageway 62 of the heat exchange means 50 by the blower unit 99 in communication with the bottom of the gas passageway 62, the blower unit 99 may also draw fresh atmospheric air from the atmosphere and force it upwardly through the gas passageway 62 of the heat exchange means 50, as illustrated by the flow arrow 110 in FIG. 2. In addition to this flow of fresh atmospheric air through the gas passageway 62, fresh ambient heated air that surrounds the exterior of combustion chamber 72 and is not produced by the flame in the combustion chamber 72 is also forced by the blower unit 99 upwardly through the gas passageway 62. The fresh ambient heated air is contained within the heat shield chamber 80 externally of the combustion chamber 72 and flows through an opening 112 in the heat shield bottom wall 85. The fresh ambient heat air then passes under the front wall 53 of the heat exchange means 50 into the upward flow of combustion air in the gas passageway 62 of the heat exchange means 50, as illustrated in FIG. 2 by the flow arrow 115.

Therefore, the gas discharged from the top of the heat exchange means 50 is a combination of combustion air from the conducting means 92, combustion air from the perforations 104 in the top walls 102 of the tubular radiator elements 64, fresh atmospheric air from the blower 99 and fresh ambient heated air from the heat shield chamber 80. The combined flow from the top of the gas passageway 62 is introduced into the granular-material conduit through the inner foraminous wall means 33 of the respective branches 30 and 31 as shown in FIG. 1.

Referring to FIGS. 3 and 4, the heat exchange means 50, illustrated in FIG. 2, includes heat conductive distribution means 120 disposed in the gas passageway 62 of the heat exchange means 50 externally of the tubular radiator elements and in communication therewith to distribute heat from the tubular radiator elements 64 to the combined flow of gas passing through the gas passageway 62 in external communication with said tubular radiator elements 64. For this purpose, the heat conductive distribution means 120 comprises a series of elongated flat heat conductive vanes which extend longitudinally across the full width of the gas passageway 62 between the opposing end walls 52 of the heat exchange means 50. The vanes extend longitudinally and externally from said tubular radiator elements 64 generally transverse to the direction of the flow of the discharged combustion gas through the gas passageway 62 in external communication with the tubular radiator elements. The elongated vanes also extend respectively through the hollow interiors 65 of the tubular radiator elements 64 through the opposing side walls 66A of the respective tubular radiator elements 64. The vanes extend through the interiors of the tubular radiator elements generally transverse to the flow of hot combustion gas therethrough. Each of the vanes also extend transversely through each of the tubular radiator elements, although other orientations are possible.

The flat vanes are arranged in a series of four generally horizontal rows with each row having eight horizontally adjacent vanes. The horizontal rows of vanes are disposed vertically adjacent to one another such that eight vertical columns are formed with each vertical column containing four vertically adjacent vanes. The vanes in vertically adjacent rows are staggered in a zig-zag array with the opposing flat faces 125 of the vanes being disposed at angles both to the direction of the combined flow of gas upwardly through the gas passageway 62 and to the direction of the flow of hot combustion gas through the interior 65 of each of the tubular radiator elements 64. The vanes in any particular column are oriented in zig-zag formation while the vanes in any particular row are generally uniformly oriented. The horizontal flow of hot combustion gas within the interior of the tubular radiator elements 64 is deflected alternately upwardly and downwardly between adjacent horizontal rows, and the vertical flow of gas externally of the tubular radiator elements 64 through the gas passageway 62 is deflected alternately to the left and to the right by the successive vanes in each of the vertical columns of vanes.

The portion of the vanes disposed within the hollow interiors of the tubular radiator elements 64 conduct heat from the hot combustion gas flowing therethrough and subsequently transfer the heat to the tubular radiator elements and to the portions of the vanes disposed externally of said tubular radiator elements. The portions of the vanes disposed in the gas passageway 62 externally of the tubular radiator elements 64 distribute the heat from the tubular radiator elements 64 and from the portions of the vanes disposed within the interiors of the tubular radiator elements to the combined flow of gas passing upwardly through the gas passageway 62 in external communication with the tubular radiator elements. With the vanes being arranged in a zig-zag array with angular orientations, the flow of the combustion gas through the generally tubular radiator elements 64 and the gas passageway 62 of the heat exchange means 50 will be deflected and dispersed by the vanes to provide better heat conduction and distribution. Therefore, in accordance with the preferred embodiment of this invention, a grain dryer having a heat exchange assembly is provided that efficiently utilizes the heat generated by combustion within a burner without the danger of flame or spark damage to the granular material that may be caused by the direct impingement of the combustion gas on the granular material being dried.

While a certain embodiment of the present invention has been specifically illustrated and described, it is to be understood that variations, combinations, and subcombinations may be made by one skilled in the art within the scope of the following claims.

What is claimed is:

1. An apparatus for drying granular material comprising:

(a) a housing;

(b) means defining a granular-material conduit for conducting said granular material through said housing;

(c) heat exchange means having at least one generally tubular radiator element;

(d) means for producing a flow of hot combustion gas through the interior of said tubular radiator element to transfer heat from said hot combustion gas to said tubular radiator element, said combustion gas being discharged from the interior of said tubular radiator element at a reduced temperature;

(e) gas conducting means communicating with said tubular radiator element for directing the flow of discharged combustion gas from said tubular radiator element into external communication with said tubular radiator element to increase the temperature of the discharged combustion gas;

(f) means for introducing the flow of the discharged combustion gas in external communication with said tubular radiator element into said granular-material conduit to treat said granular material therein; and (g) separation means in the flow of combustion gas for removing particulate material from the combustion gas prior to its introduction into said granular-material conduit.

2. A heat exchange apparatus comprising:

(a) heat exchange means having at least one tubular radiator element;

(b) means for producing a flow of hot combustion gas through the interior of said tubular radiator element to transfer heat from said hot combustion gas to said tubular radiator element, the flow of combustion gas being discharged from the interior of said tubular radiator element at a reduced temperature;

(c) gas conducting means communicating with said tubular radiator element for directing the flow of discharged combustion gas from said tubular radiator element into external communication with said tubular radiator element to increase the temperature of the discharged combustion gas; and (d) separation means in the flow of combustion gas for removing particulate material from the combustion gas.

3. An apparatus in accordance with claim 1 or 2 wherein said heat exchange means includes heat-conductive distribution means disposed externally of said tubular radiator element and in communication therewith for distributing heat to the discharged combustion gas flowing an external communication with said tubular radiator element.

4. An apparatus in accordance with claim 3 wherein said heat-conductive distribution means comprises at least one flat elongated heat-conductive vane extending longitudinally from said tubular radiator element generally transverse to the direction of the flow of the discharged combustion gas in external communication with said tubular radiator element, said vane having its opposing flat faces disposed at an angle with respect to the direction of the flow of the discharged combustion gas in external communication with said tubular radiator element.

5. An apparatus in accordance with claim 3 wherein said heat-conductive distribution means comprises a series of flat elongated heat-conductive vanes extending longitudinally from and externally of said tubular radiator element, said series of vanes being disposed in zigzag array with the flat faces of the respective vanes being disposed at angles to the direction of the flow of the discharged combustion gas in external communication with said tubular radiator element.

6. An apparatus in accordance with claim 1 or 2 wherein said heat exchange means includes heat-conductive distribution means disposed within the interior of said tubular radiator element and in communication therewith for conducting heat from the hot combustion gas flowing through the interior of said tubular radiator element.

7. An apparatus in accordance with claim 6 wherein said heat-conductive distribution means comprises at least one flat elongated heat-conductive vane extending longitudinally through the interior of said tubular radiator element generally transverse to the direction of the flow of the hot combustion gas therethrough, said vane having its opposing flat faces disposed at an angle to the direction of the flow of the hot combustion gas through the interior of said tubular radiator element.

8. An apparatus in accordance with claim 6 wherein said heat-conductive distribution means comprises a series of flat elongated heat conductive vanes extending longitudinally through the interior of said tubular radiator element, said series of vanes being disposed in zigzag array at angles to the direction of the flow of the hot combustion gas through the interior of said tubular radiator element.

9. An apparatus in accordance with claim 1 or 2 wherein the interior of said tubular radiator element is disposed generally horizontally so that the flow of hot combustion gas therethrough is generally horizontal, and wherein further said gas conducting means directs the flow of the discharged combustion gas from said tubular radiator element generally vertically upward into external communication with said tubular radiator element.

10. An apparatus in accordance with claim 9 wherein said tubular radiator element has means defining at least one aperture through the top of said horizontally disposed tubular radiator element, said aperture permitting a flow of hot combustion gas generally vertically upwardly therethrough, said flow of hot combustion gas through said aperture being intermixed with the upward flow of the discharged combustion gas in external communication with said tubular radiator element to form a combined flow.

11. An apparatus in accordance with claim 1 or 2 wherein said separation means comprises filter means for eliminating large-size particulate materials from said flow of combustion gas.

12. An apparatus in accordance with claim 11 wherein said filter means comprises a screen.

13. An apparatus in accordance with claim 12 wherein said screen is disposed across the interior of said gas conducting means generally transverse to the direction of the flow of the discharged combustion gas therethrough.

14. An apparatus in accordance with claim 1 or 2 wherein said gas conducting means comprises a duct having impervious walls deflecting the discharged combustion gas through 270°, and wherein further said walls include said separation means.

15. An apparatus in accordance with claim 1 wherein said granular-material conduit comprises foraminous walls, and wherein further the flow of the discharged combustion gas in external communication with said tubular radiator element is introduced into said granular-material conduit through said foraminous walls.

16. An apparatus in accordance with claim 15 wherein said granular-material conduit is generally vertical to form a column so that said granular material moves through said column in response to gravity.

17. An apparatus in accordance with claim 15 or 16 wherein said conduit comprises at least two generally vertical branches having said foraminous walls, said branches being spaced apart, with said heat exchange means being disposed therebetween, and wherein further the flow of combustion gas in external communication with said tubular radiator element is introduced into each of said branches through said foraminous walls.

18. An apparatus in accordance with claim 1 or 2 including means to introduce fresh air into the flow of the discharged combustion gas in external communication with said tubular radiator element.

19. An apparatus in accordance with claim 18 wherein said fresh air is atmospheric air.

20. An apparatus in accordance with claim 18 wherein said fresh air is ambient air surrounding said means for producing a flow of hot combustion gas through the interior of said tubular radiator element.

21. An apparatus for drying granular material comprising:

(a) a housing;

(b) means defining a granular-material conduit for conducting said granular material through said housing;

(c) heat exchange means having a plurality of generally tubular radiator elements and an inlet manifold and an outlet manifold in communication with the respective opposite ends of said tubular radiator elements;

(d) means for producing a flow of hot combustion gas through said inlet manifold to separate the flow of hot combustion gas into a plurality of individual flows respectively passing through the interiors of said tubular radiator elements to transfer heat from said hot combustion gas to said tubular radiator elements, the individual flows of combustion gas being discharged through said outlet manifold to combine the flows, with the temperature of the discharged combustion gas being reduced;

(e) gas conducting means communicating with said outlet manifold for directing the flow of discharged combustion gas from said outlet manifold into external communication with said tubular radiator elements to increase the temperature of the discharged combustion gas;

(f) means for introducing the flow of the discharged combustion gas in external communication with said tubular radiator elements into said granular-material conduit to treat said granular material therein; and (g) seperation means in the flow of said combustion gas for removing particulate material from said combustion gas prior to its introduction into said granular-material conduit.

22. A heat exchange apparatus comprising:

(a) heat exchange means having a plurality of generally tubular radiator elements and an inlet manifold and an outlet manifold communicating with the respective opposite ends of said tubular radiator elements;

(b) means for producing a flow of hot combustion gas through said inlet manifold to separate the flow of hot combustion gas into a plurality of individual flows respectively passing through the interiors of said tubular radiator elements to transfer heat from said hot combustion gas to said tubular radiator elements, the individual flows of combustion gas being discharged through said outlet manifold to combine the flows, with the temperature of the discharged combustion gas being reduced;

(c) gas conducting means communicating with said outlet manifold for directing the flow of discharged combustion gas from said outlet manifold into external communication with said tubular radiator elements to increase the temperature of the discharged combustion gas; and (d) separation means in the flow of said combustion gas for removing particulate material from said combustion gas.

23. An apparatus in accordance with claim 21 or 22 wherein said heat exchange means includes heat-conductive distribution means disposed externally of said tubular radiator elements and in communication therewith for distributing heat to the discharged combustion gas flowing in external communication with said tubular radiator elements.

24. An apparatus in accordance with claim 23 wherein said tubular radiator elements are disposed adjacent to one another in a side by side array with the individual flows of the hot combustion gas through the respective interiors of said tubular radiator elements being generally parallel.

25. An apparatus in accordance with claim 24 wherein said heat-conductive distribution means comprises at least one flat elongated heat-conductive vane extending longitudinally from said tubular radiator elements generally transverse to the direction of the flow of the discharged combustion gas in external communication with said tubular radiator elements, said vane having its opposing flat faces disposed at an angle with respect to the direction of the flow of the discharged combustion gas in external communication with said tubular radiator elements.

26. An apparatus in accordance with claim 24 wherein said heat-conductive distributor means comprises a series of flat elongated heat-conductive vanes extending longitudinally from and externally of said tubular radiator elements, said series of vanes being disposed in zig-zag array with the flat faces of the respective vanes being disposed at angles to the direction of the flow of the discharged combustion gas in external communication with said tubular radiator elements.

27. An apparatus in accordance with claim 21 or 22 wherein said heat exchange means includes heat-conductive distribution means disposed within the interior of said tubular radiator elements and in communication therewith for conducting heat from the hot combustion gas flowing through the interior of said tubular radiator elements.

28. An apparatus in accordance with claim 27 wherein said tubular radiator elements are disposed adjacent to one another in a side by side array with the individual flows of the hot combustion gas through the respective interiors of said tubular radiator elements being generally parallel.

29. An apparatus in accordance with claim 28 wherein said heat-conductive distribution means comprises at least one flat elongated heat-conductive vane extending longitudinally through the interior of said tubular radiator elements generally transverse to the direction of the flow of hot combustion gas therethrough, said vane having its opposing flat faces disposed at an angle to the direction of the flow of the hot combustion gas through the interior of said tubular radiator elements.

30. An apparatus in accordance with claim 28 wherein said heat-conductive distribution means comprises a series of flat elongated heat conductive vanes extending longitudinally through the interior of said tubular radiator elements, said series of vanes being disposed in zig-zag array at angles to the direction of the flow of the hot combustion gas through the interior of said tubular radiator elements.

31. An apparatus in accordance with claim 21 or 22 wherein the interiors of said tubular radiator elements are disposed generally horizontally so that the flow of the hot combustion gas respectively therethrough is generally horizontal, and wherein further said gas conducting means directs the flow of the discharged combustion gas from said outlet manifold generally vertically upward into external communication with said tubular radiator elements.

32. An apparatus in accordance with claim 31 wherein each of said tubular radiator elements has means defining at least one aperture through the top thereof, said aperture permitting hot combustion gas to flow upwardly therethrough, said flow of hot combustion gas through said aperture being intermixed with the upward flow of the discharged combustion gas in external communication with said tubular radiator elements to form a combined flow.

33. An apparatus in accordance with claim 21 or 22 wherein said separation means comprises filter means for eliminating large-size particulate materials from said flow of combustion gas.

34. An apparatus in accordance with claim 33 wherein said filter means comprises a screen.

35. An apparatus in accordance with claim 34 wherein said screen is disposed across the interior of said gas conducting means generally transverse to the direction of the flow of the discharged combustion gas therethrough.

36. An apparatus in accordance with claim 21 or 22 including means to introduce fresh air into the flow of the discharged combustion gas in external communication with said tubular radiator elements.

37. An apparatus in accordance with claim 36 wherein said fresh air is atmospheric air.

38. An apparatus in accordance with claim 36 wherein said fresh air is ambient air surrounding said means for producing a flow of hot combustion gas through said inlet manifold.

* * * * *